US007090769B1

(12) United States Patent
Peterson et al.

(10) Patent No.: US 7,090,769 B1
(45) Date of Patent: Aug. 15, 2006

(54) VACUUM FOR SPAS AND METHOD OF USE

(76) Inventors: John C. Peterson, 32732 Ridge Top La., Castaic, CA (US) 91384; Marilyn G. Peterson, 32732 Ridge Top La., Castaic, CA (US) 91384

( * ) Notice: Subject to any disclaimer, the term of this patent is extended or adjusted under 35 U.S.C. 154(b) by 138 days.

(21) Appl. No.: 10/862,751

(22) Filed: Jun. 7, 2004

Related U.S. Application Data

(60) Provisional application No. 60/480,178, filed on Jun. 20, 2003.

(51) Int. Cl.
*B08B 9/00* (2006.01)
*B01D 29/58* (2006.01)

(52) U.S. Cl. ..... 210/167; 210/232; 210/416.1; 210/484; 210/489; 15/1.7; 4/490; 134/22.1

(58) Field of Classification Search ..... 210/169, 210/232, 416.1, 416.2, 483, 484, 488, 489, 210/167; 15/1.7; 4/490, 496; 134/22.1
See application file for complete search history.

(56) References Cited

U.S. PATENT DOCUMENTS 4,584,733 A * 4/1986 Tietge et al. ..... 15/1.7
4,797,206 A * 1/1989 Lynch ..... 210/169
4,935,980 A * 6/1990 Leginus et al. ..... 15/1.7
5,122,285 A * 6/1992 Tartal ..... 210/787
5,542,142 A * 8/1996 Young ..... 15/1.7
6,165,358 A * 12/2000 Denkewicz et al. ..... 210/167
6,248,232 B1 * 6/2001 Stoner ..... 210/136
6,502,269 B1 * 1/2003 Balchan et al. ..... 15/1.7
2004/0079690 A1 * 4/2004 Erlich ..... 210/169

* cited by examiner

*Primary Examiner*—Fred G. Prince
(74) *Attorney, Agent, or Firm*—Ted Masters

(57) ABSTRACT

An improved spa vacuum for removing debris from the bottom of a spa or hot tub includes a removable lower assembly which includes a filter assembly. The filter assembly includes a filter housing having three stacked filter elements. The spa vacuum also has a removable nozzle having rounded side edges. A compression fitting connects a telescoping pole to an upper chamber cap of a debris chamber. The telescoping pole may be removed from the debris chamber if damaged or for purposes of packaging and shipping.

8 Claims, 4 Drawing Sheets

20
40
38
36
64
30
28
26
24
32
22
33

VACUUM FOR SPAS AND METHOD OF USE

CROSS REFERENCE TO RELATED APPLICATION

This application claims the filing benefit under 35 U.S.C. §119(e) of U.S. Provisional Application No. 60/480,178 filed Jun. 20, 2003, which is included herein by reference.

TECHNICAL FIELD

The present invention generally pertains to spas, and hot tubs, and more particularly to an improved spa vacuum which may be utilized to remove debris from the bottom of a spa or hot tub.

BACKGROUND OF THE INVENTION

Spas which typically reside below ground, and hot tubs which typically reside above ground, are popular recreational feature in many homes. These devices include a system for filtering and heating the water. However, unlike their swimming pool counter part, spas and hot tubs are usually not equipped with a bottom cleaning system such as a manual or automatic vacuum. As such, over time debris can collect at the bottom of the spa or hot tub. Since the spa and hot tub do not have a vacuum system, the removal of such debris can be both troublesome and time consuming. Small, portable vacuums have been developed to solve this problem. For example, U.S. Pat. No. 4,935,980 discloses a device for selectively cleaning debris from the bottom of a liquid pool. The device has a chamber having a water intake tube having an inlet end and extends through the lower end of the chamber and terminates in an outlet end which has a one-way valve mounted thereon. The lower end of the chamber has an opening for dumping water from the chamber. A valve is provided for blocking the opening by the water pressure of the pool and a filtering means is provided for filtering debris from the water before being dumped through the opening. An ambient air intake tube is connected to the upper end of the chamber and has an opening whereby ambient air can be trapped in the chamber by the operator.

BRIEF SUMMARY OF THE INVENTION

The present invention is directed to several improvements to spa vacuums of the type disclosed in U.S. Pat. No. 4,935,980. These improvements greatly enhance the operational efficiency of the spa vacuum. The spa vacuum of the present invention has a removable nozzle having rounded side edges to better conform to the surface of the spa. The spa vacuum further includes a filter assembly having a plurality of removable filter elements which snap into a filter housing. The spa vacuum also has an aluminum telescoping pole which extends to a length of 7 feet, the telescoping pole having a collet which requires only one half turn to loosen, and the telescoping pole connected to a debris chamber with a threaded compression fitting. The spa vacuum also includes a replaceable check valve, and a lower assembly which is removable from the debris chamber by a one half turn quick release lock. It may be appreciated that while the spa vacuum of the present invention is ideal for use on spas and hot tubs, it may also be used in swimming pools, particularly at the shallow end. The improved spa vacuum of the present invention is available from Rola-Chem Corp/ Paradise Industries, 5858 Centerville Road, St. Paul, Minn. 55127.

In accordance with a preferred embodiment of the invention, an improved spa vacuum of the type having (1) a nozzle removably connected to one end of a debris intake tube, (2) a check valve attached to the other end of the debris intake tube, (3) a debris chamber having an upper chamber cap and a lower chamber cap, (4) a filtering means, and (5) a telescoping pole connected to the upper chamber cap of the debris chamber, wherein the nozzle, the debris intake tube, the check valve, and the filtering means are disposed in a lower assembly which is selectively removable from the lower chamber cap of the debris chamber, the improvement comprising;

the filtering means of the lower assembly including a filter assembly, the filter assembly including:

a filter housing;

a filter retainer screen removably disposed within the filter housing;

a filter pad removably disposed within the filter housing;

a filter support screen removably disposed within the filter housing;

the filter retainer screen, the filter pad, and the filter support are disposed in stacked relationship within the filter housing; and, so that to effect cleaning the filter assembly may be removed from the lower assembly and the filter retainer screen, the filter pad, and the filter support screen removed from the filter housing.

In accordance with an aspect of the invention:

the nozzle has rounded side edges.

In accordance with another aspect of the invention:

a compression fitting connects the telescoping pole to the upper chamber cap; and, wherein the telescoping pole may be removed from the debris chamber if damaged or for purposes of packaging and shipping.

In accordance with another aspect of the invention:

the check valve is selectively connected to the debris intake tube by a snap connector.

In accordance with another aspect of the invention:

the lower assembly selectively connected to the lower chamber cap of the debris chamber by a one-half turn groove and tab connector.

In accordance with another aspect of the invention:

sections of the telescoping pole connected by a one-half turn collet.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
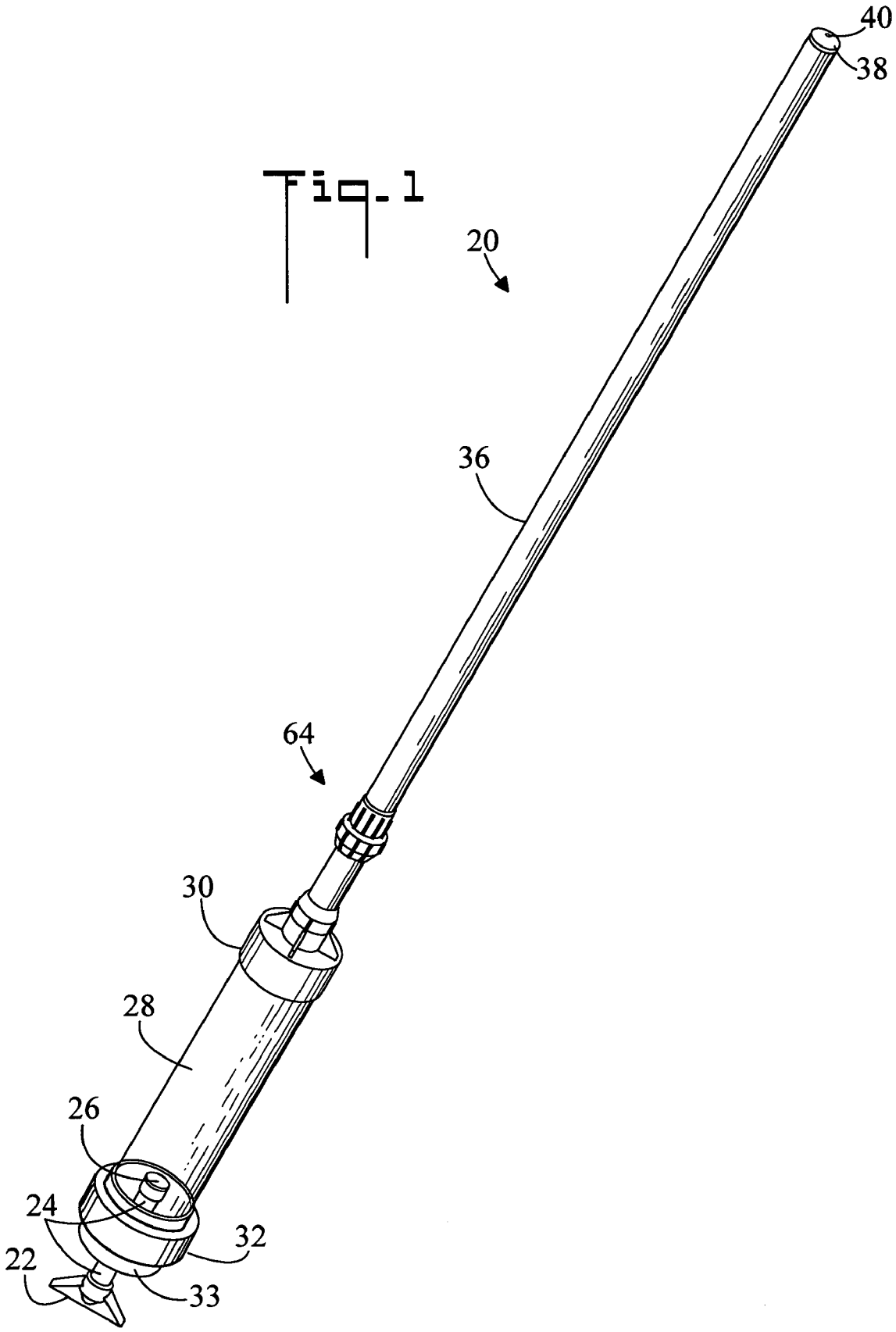
FIG. 1 is a perspective view of an improved spa vacuum in accordance with the present invention.

Referring initially to FIG. 1, there is illustrated a perspective view of an improved spa vacuum in accordance with the present invention, generally designated as 20. Spa vacuum 20 includes a debris-receiving nozzle 22 which is removably connected to one end of a debris intake tube 24. A check valve 26 is removably connected to the other end of debris intake tube 24. A clear debris chamber 28 has an upper chamber cap 30 and a lower chamber cap 32 (also refer to FIG. 2). Spa vacuum 20 also has a debris filter assembly 34 housed within a lower assembly 33 (refer to FIGS. 2 and 3), and a telescoping pole 36 connected to upper chamber cap 30 of debris chamber 28. Telescoping pole 36 is extendable to a length of 7 feet. This allows a user to conveniently clean large spas and hot tubs. Nozzle 22, debris intake tube 24, check valve 26, and debris filter assembly 34 are disposed in the lower assembly 33 which is selectively removable from lower chamber cap 32 of debris chamber 28.

Spa vacuum 20 is designed to be airtight from nozzle 22 to the top of telescoping pole 36. The top of telescoping pole 36 is fitted with a small plastic disc 38 having a hole 40. To operate spa vacuum 20, hole 40 is covered with a finger, nozzle 22 is submerged into the water in the proximity of the debris to be removed, and the finger is released. When the air is no longer trapped by the finger, the water in spa vacuum 20 seeks its own level, which in turn creates suction which pulls water and the debris into debris chamber 28 through nozzle 22. When the suction action stops, check valve 26 closes thereby preventing the debris from falling back into the spa. The spa vacuum 20 is then lifted out of the spa, and the water in the debris chamber 28 drains through the filter assembly 34 back into the spa, with the debris being trapped in the debris chamber 28.

Figure 2:
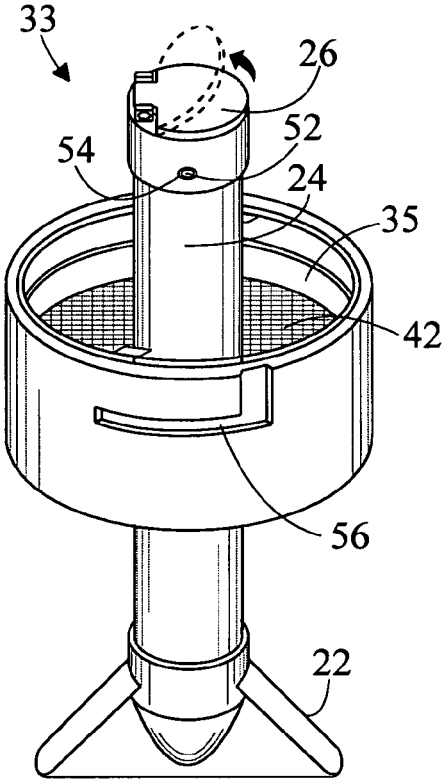
FIG. 2 is an enlarged perspective view of a lower assembly of the spa vacuum.
Figure 3:
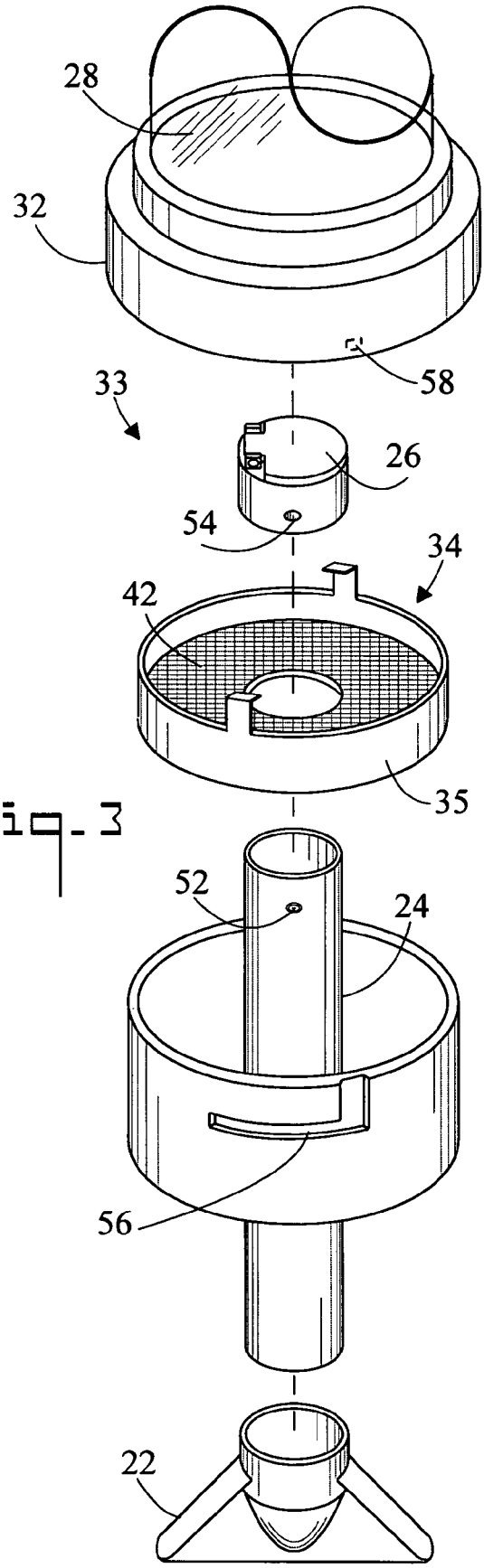
FIG. 3 is an enlarged exploded perspective view of the lower assembly.
Figure 6:
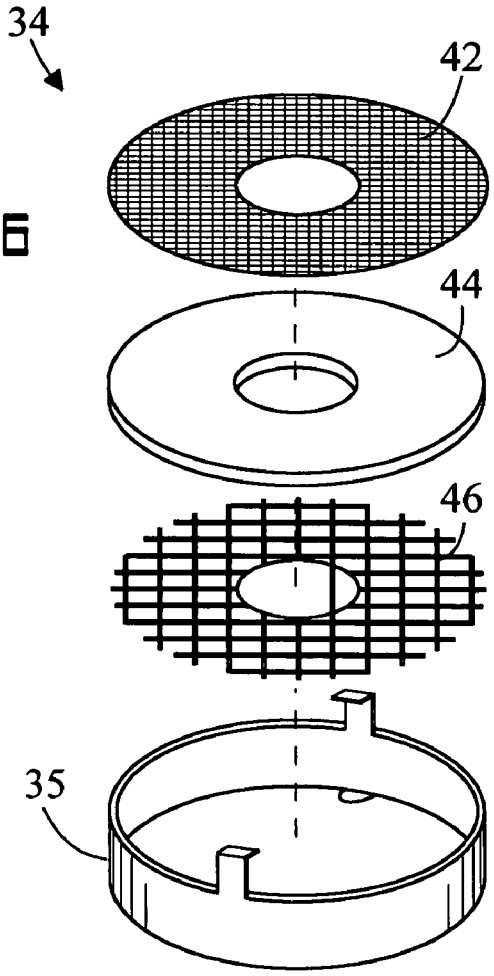
FIG. 6 is an enlarged exploded view of a filter assembly.

Now referring to FIGS. 2 and 3, there are illustrated enlarged perspective and enlarged exploded perspective views respectively of lower assembly 33. Lower assembly 33 includes filter housing 34 which is installed over debris intake tube 24. Referring also to FIG. 6, filter assembly 34 includes a filter housing 35, a filter retainer screen 42, a filter pad 44, and a filter support screen 46 which are removably disposed in stacked relationship within filter housing 35. The three filter elements are stacked and then snap into filter housing 35. In an embodiment of the invention, filter pad 44 comprises a 50 micron filter. With this structure, filter assembly 34 may be easily removed from lower assembly 33 and filter retainer screen 42, filter pad 44, and filter support screen 46 removed from filter housing 35 and cleaned.

Figure 4:
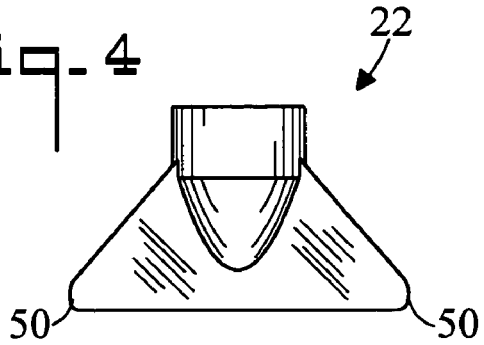
FIG. 4 is an enlarged top plan view of a debris-receiving nozzle.
Figure 5:
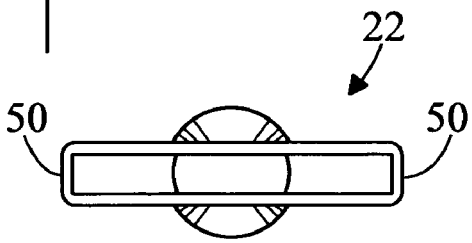
FIG. 5 is an enlarged front elevation view of the debris-receiving nozzle.

In another embodiment of the invention, nozzle 22 has rounded side edges 50 so that nozzle 22 will better conform to the bottom surface of the spa (also refer to FIGS. 4 and 5).

Spa vacuum 20 also includes check valve 26 being selectively connected to debris intake tube 24 by a snap connector. In the shown embodiment, snap connector comprises a protrusion 52 on debris intake tube 24 which engages a hole 54 on check valve 26. The dashed line depicts check valve 26 in the open position in which water and debris travels from nozzle 22 to debris chamber 28. This feature of the present invention is useful in that check valve 26 may be easily replaced should it become damaged.

In another feature of the present invention, lower assembly 33 is selectively connected to the lower chamber cap 32 of debris chamber 28 by a one-half turn groove and tab connector. Groove 56 in lower assembly 33 cooperates with tab 58 in lower chamber cap 32 to effect the connection. This quick lock feature facilitates emptying debris from debris chamber 28. An O-ring (not shown) in lower chamber cap 32 ensures an air tight seal with lower assembly 33.

FIG. 4 is an enlarged top plan view of debris-receiving nozzle 22 showing rounded side edges 50.

FIG. 5 is an enlarged front elevation view of the debris-receiving nozzle 22.

FIG. 6 is an enlarged exploded view of filter assembly 34 showing filter housing 35, filter retainer screen 42, filter pad 44, and filter support screen 46.

Figure 7:
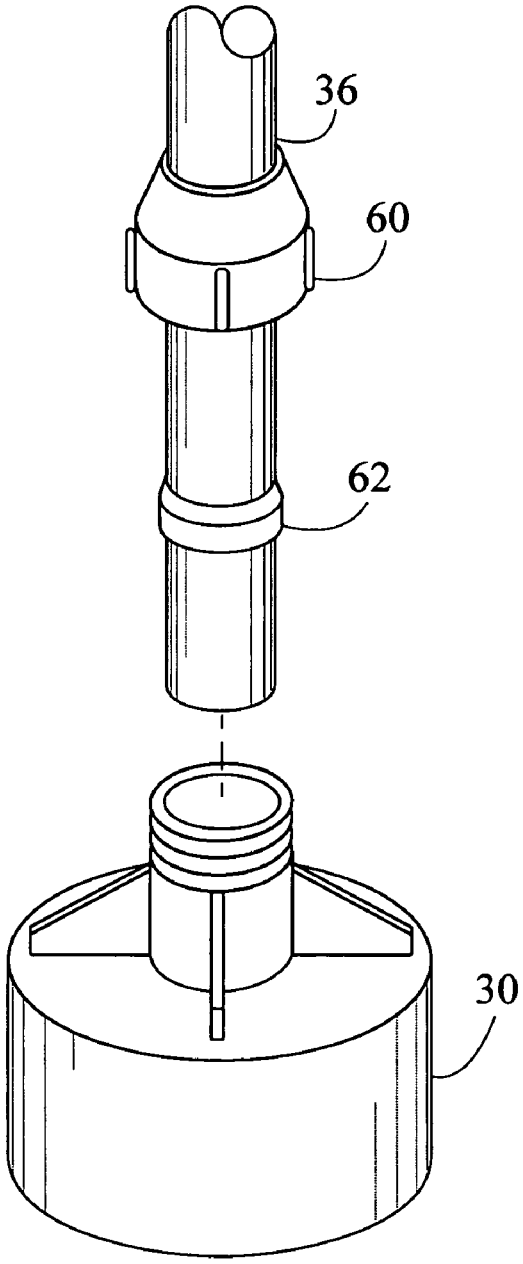
FIG. 7 is an enlarged exploded view of a pole connecting to the upper chamber cap of the debris chamber; and, FIG. 8 is an enlarged exploded view of a pole collet.

FIG. 7 is an enlarged exploded view of pole 36 connecting to upper chamber cap 30 of the debris chamber 28 (refer to FIG. 1). A threaded compression fitting 60 engages threads on upper chamber cap 30. A Delrin ring 62 ensures and air tight seal. With this structure, telescoping pole 36 may be removed from chamber 28 if it is damaged or for purposes of packaging and shipping.

Figure 8:
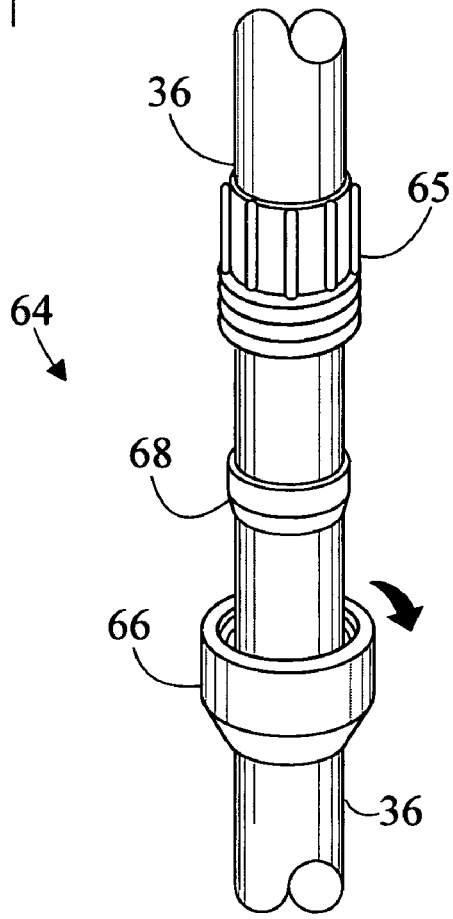

FIG. 8 is an enlarged exploded view of a pole collet 64. Pole collet 64 allows telescoping pole 36 to be extended or compressed by loosening and then tightening outer ring 66 onto receptacle 65. Pole collet 64 is unique in that only one half turn of outer ring 66 is required to loosen collet 64. Conversely, other collets are threaded and require several full turns to loosen. Delrin ring 68 provides an air tight seal for pole 36. In the shown view, the portion of pole 36 above outer ring 66 fits (telescopes) inside the portion of pole 36 below outer ring 66.

In terms of use, a method for cleaning debris from the bottom of a spa, comprising:

(a) providing a spa having a bottom, debris disposed upon said bottom;

(b) providing a spa vacuum 20 having:

- a nozzle 22 removably connected to one end of a debris intake tube 24;
- a check valve 26 removably connected to the other end of the debris intake tube 24;
- a debris chamber 28 having an upper chamber cap 30 and a lower chamber cap 32;
- a filtering means;
- a telescoping pole 36 connected to the upper chamber cap 30 of debris chamber; 28
- nozzle 22, debris intake tube 24, check valve 26, and the filtering means disposed in a lower assembly 33 which is selectively removable from lower chamber cap 32 of debris chamber 28;
- the filtering means of lower assembly 33 including a filter assembly 34 which includes:
  - a filter housing 35;
  - a filter retainer screen 42 removably disposed within filter housing 35;
  - a filter pad 44 removably disposed within filter housing 35
  - a filter support screen 46 removably disposed within filter housing 35;
  - filter retainer screen 42, filter pad 44, and filter support screen 46 disposed in stacked relationship within filter housing 35 and,
- nozzle 22 having rounded side edges;

(c) using spa vacuum 20 to remove the debris from the bottom of the spa;

(d) removing lower assembly 33 from lower chamber cap 32 of debris chamber 28;

(e) removing filter housing 35 from lower assembly 33;

(f) removing filter retainer screen 42, filter pad 44, and filter support screen 46 from filter housing 35;

(g) cleaning filter retainer screen 42, filter pad 44, and filter support screen 46;

(h) reinstalling filter retainer screen 42, filter pad 44, and filter support screen 46 into filter housing 35;

(i) reinstalling filter housing 35 into lower assembly 33;

(j) reconnecting lower assembly 33 with lower chamber cap 32 of debris chamber 28; and, (k) again using spa vacuum 20 to remove debris from the bottom of the spa.

The preferred embodiments of the invention described herein are exemplary and numerous modifications, variations, and rearrangements can be readily envisioned to achieve an equivalent result, all of which are intended to be embraced within the scope of the appended claims.

We claim:

1. A method for cleaning debris from the bottom of a spa, comprising:

(a) providing a spa having a bottom, debris disposed upon said bottom;

(b) providing a spa vacuum having:

a nozzle removably connected to one end of a debris intake tube;

a check valve removably connected to the other end of said debris intake tube;

a debris chamber having an upper chamber cap and a lower chamber cap;

a filtering means;

a telescoping pole connected to said upper chamber cap of said debris chamber;

said nozzle, said debris intake tube, said check valve, and said filtering means disposed in a lower assembly which is selectively removable from said lower chamber cap of said debris chamber;

said filtering means of said lower assembly including a filter assembly, said filter assembly including:

a filter housing;

a filter retainer screen removably disposed within said filter housing;

a filter pad removably disposed within said filter housing;

a filter support screen removably disposed within said filter housing;

said filter retainer screen, said filter pad, and said filter support screen disposed in stacked relationship within said filter housing; and, said nozzle having rounded side edges;

(c) using said spa vacuum to remove said debris from said bottom of said spa;

(d) removing said lower assembly from said lower chamber cap of said debris chamber;

(e) removing said filter housing from said lower assembly;

(f) removing said filter retainer screen, said filter pad, and said filter support screen from said filter housing;

(g) cleaning said filter retainer screen, said filter pad, and said filter support screen;

(h) reinstalling said filter retainer screen, said filter pad, and said filter support screen into said filter housing;

(i) reinstalling said filter housing into said lower assembly;

(j) reconnecting said lower assembly with said lower chamber cap of said debris chamber; and, (k) again using said spa vacuum to remove said debris from said bottom of said spa.

2. An improved spa vacuum of the type having (1) a nozzle removably connected to one end of a debris intake tube, (2) a check valve attached to the other end of the debris intake tube, (3) a debris chamber having an upper chamber cap and a lower chamber cap, (4) a filtering means, and (5) a telescoping pole connected to the upper chamber cap of the debris chamber, wherein the nozzle, the debris intake tube, the check valve, and the filtering means are disposed in a lower assembly which is selectively removable from the lower chamber cap of the debris chamber, the improvement comprising;

the filtering means of the lower assembly including a filter assembly, said filter assembly including:

a filter housing;

a filter retainer screen removably disposed within said filter housing;

a filter pad removably disposed within said filter housing;

a filter support screen removably disposed within said filter housing;

said filter retainer screen, said filter pad, and said filter support are disposed in stacked relationship within said filter housing; and, so that to effect cleaning said filter assembly may be removed from the lower assembly and said filter retainer screen, said filter pad, and said filter support screen removed from said filter housing.

3. The spa vacuum of claim 2, further including:

the nozzle having rounded side edges.

4. The spa vacuum of claim 2, further including:

a compression fitting connecting the telescoping pole to the upper chamber cap; and, wherein the telescoping pole may be removed from the debris chamber if damaged or for purposes of packaging and shipping.

5. The spa vacuum of claim 2, further including:

the check valve being selectively connected to the debris intake tube by a snap connector.

6. The spa vacuum of claim 2, further including:

the lower assembly selectively connected to the lower chamber cap of the debris chamber by a one-half turn groove and tab connector.

7. The spa vacuum of claim 2, further including:

sections of the telescoping pole connected by a one-half turn collet.

8. The spa vacuum of claim 2, further including:

the nozzle having rounded side edges;

a compression fitting connecting the telescoping pole to the upper chamber cap;

wherein the telescoping pole may be removed from the debris chamber if damaged or for purposes of packaging and shipping;

the check valve being selectively connected to the debris intake tube by a snap connector;

the lower assembly selectively connected to the lower chamber cap of the debris chamber by a one-half turn groove and tab connector; and, sections of the telescoping pole connected by a one-half turn collet.

* * * * *